US005152683A

United States Patent [19]

Signorelli

[11] Patent Number: 5,152,683

[45] Date of Patent: Oct. 6, 1992

[54] DOUBLE ROTARY PISTON POSITIVE DISPLACEMENT PUMP WITH VARIABLE OFFSET TRANSMISSION MEANS

[76] Inventor: Richard L. Signorelli, 43 Sherwood Dr., Torrington, Conn. 06790

[21] Appl. No.: 722,114

[22] Filed: Jun. 27, 1991

[51] Int. Cl.[5] ..... F04C 1/14

[52] U.S. Cl. ..... 418/109; 418/204; 418/127

[58] Field of Search ..... 418/109, 204, 270, 127

[56] References Cited

U.S. PATENT DOCUMENTS

| | | | |
|---|---|---|---|
| 20,796 | 7/1858 | Holly . | |
| 628,906 | 7/1899 | Grindrod . | |
| 799,677 | 9/1905 | Schluter . | |
| 1,771,863 | 7/1930 | Schmidt . | |
| 1,837,714 | 12/1931 | Jaworowski | 418/204 |
| 1,900,416 | 3/1933 | Izbicki . | |
| 2,453,284 | 11/1948 | Tornborg . | |
| 2,698,130 | 12/1954 | Mossin . | |
| 3,078,807 | 2/1963 | Thompson | 418/204 |
| 3,726,617 | 4/1973 | Daido . | |
| 4,753,585 | 6/1988 | Thompson | 418/127 |

FOREIGN PATENT DOCUMENTS

| | | | |
|---|---|---|---|
| 938436 | 1/1950 | Fed. Rep. of Germany | 418/204 |

OTHER PUBLICATIONS

Plant Engineering, Fluid Handling Pumps, E. Cunningham (Ed.).

Mechanical Engineer's Handbook, ed by L., Marks, pp. 1844-1845, McGraw-Hill Book Company, Inc. 1951.

*Primary Examiner*—Richard A. Bertsch
*Assistant Examiner*—David L. Cavanaugh
*Attorney, Agent, or Firm*—Victor E. Libert; Frederick A. Spaeth

[57] ABSTRACT

A dual piston rotary pump (10) having a housing (12) equipped with two ports (13*a*, 13*b*) to accommodate fluid flow through the housing (12) and having two generally cylindrical chambers (14*a*, 14*b*) within which cylindrical pistons (16*a*, 16*b*) are disposed. The chambers (14*a*, 14*b*) intersect to form a passage (15) therebetween and to allow the pistons (16*a*, 16*b*) to engage in tangential contact. Each piston (16*a*, 16*b*) rotates within its chamber (14*a*, 14*b*) in a direction counter to the direction of the other piston while maintaining tangential contact with the other piston and at least one piston is in tangential contact with its chamber wall. The pump includes variable offset transmission means (52*a*, 50*a*, 48*a*, 54*a*) to change the offset of the center of the piston from the center of rotation of the piston during the course of each rotation to allow the pistons (16*a*, 16*b*) to remain in mutual tangential contact at all times. The offset transmission means (52*a*, 50*a*, 48*a*, 54*a*) allows the pistons (16*a*, 16*b*) to move in semicircular, semi-elliptical paths. The pump may further include a reversible check valve (17), and each piston may include a counterbalance (122) to minimize vibrations.

20 Claims, 9 Drawing Sheets

DOUBLE ROTARY PISTON POSITIVE DISPLACEMENT PUMP WITH VARIABLE OFFSET TRANSMISSION MEANS

BACKGROUND OF THE INVENTION

1. Field of the Invention

This invention relates to rotary pumps and more specifically to double rotary piston pumps.

2. Related Art

Conventional double rotary piston pumps operate by rotating a pair of cylindrical, i.e., generally disc-shaped, pistons within cylindrical chambers about offset parallel axes and in opposite directions. This rotation is typically accomplished by applying a driving rotation via a drive shaft or drive gear to the pistons at points offset from their centers to provide cooperating eccentric motion to each piston. To maintain pumping efficiency, the pistons should remain in mutual contact during the entirety of each cycle or period of rotation. However, in pumps of this type in the prior art, the pistons tend to move apart and lose contact with each other ("gap") during a portion of each cycle of rotation. This gapping phenomenon is caused by relative translation movement of the eccentrically-mounted pistons and is well known in the art, as evidenced by the disclosure of U.S. Pat. No. 1,837,714 to Jaworowski dated Dec. 22, 1931 (see page 1, lines 29–67 and especially lines 62–67 and FIG. 8). The gap causes a loss of the pressure drop between the inlet and outlet conduits of the pump, thereby diminishing the pumping efficiency of the pump.

To address this gapping problem, some workers have attempted to modify the shape of the pistons. For example, U.S. Pat. No. 3,726,617 to Daido dated April 10, 1973 discloses a double rotary piston pump in which the rotors or pistons have a varying radius in order to accommodate the opposing gap-causing motions of the pistons and to insure that the pistons remain in contact at all positions in the pumping cycle. Likewise, U.S. Pat. No. 1,771,863 to Schmidt dated July 29, 1930 teaches the use of pistons having a cross-sectional profile which consists of arcs of circles of differing sizes (see page 1, lines 65–75).

Another approach has been to recognize that the gap may be accommodated by the use of slightly oversized pistons to allow for mutual contact even at the position where gapping is expected to be the greatest. However, when such oversized pistons rotate through each cycle or period of rotation, a high degree of compression is attained between the pistons in positions where gapping diminishes. To accommodate this compression, it is known to cover the contact peripheral surfaces of the pistons with a compressible material which, while maintaining contact without stress in the position where gapping would be the greatest, can compress to a sufficient degree to accommodate the relative closeness of the pistons in the aligned position. Such a solution is taught, for example, by U.S. Pat. No. 3,078,807 to Thompson dated Feb. 26, 1963. Still another solution taught in the art is to rotate the pistons at various speeds through the use of elliptical drive gears, as taught by Jaworowski, U.S. Pat. No. 1,837,714 dated Dec. 22, 1931. Other attempts at improving the performance of double piston rotary pumps include the modification of the piston surface to provide a ramp or step on the surface of the pistons as shown in U.S. Pat. No. 2,453,284, to Tornborg dated Nov. 19, 1948, col. 1, line 46 to col. 2, line 24, and U.S. Pat. No. 20,796 to Holly dated July 6, 1858, col. 2, lines 71–98).

SUMMARY OF THE INVENTION

Generally, a pump according to this invention comprises variable offset transmission means to rotate the pistons without gapping or compression by varying the rotational offset of the pistons during each cycle or period of rotation.

Specifically, in accordance with the present invention there is provided a dual piston rotary pump comprising a housing defining a pump cavity having first and second generally disc-shaped chambers whose peripheral walls intersect to form a passage therebetween. The housing further defines an inlet port and an outlet port each in flow communication with the pump cavity to establish a fluid flow path through the housing. First and second disc-shaped pistons are mounted within the first and second chambers, respectively, on respective first and second variable offset transmission means carried on the housing. The pump according to this invention further comprises first and second rotating drive means coupled to the first and second variable offset transmission means, respectively, each drive means defining a drive axis of rotation parallel to the axis of the associated cylinder, for rotating the pistons. The variable offset transmission means vary the offset of the pistons in relation to the drive axes of rotation during the course of a pumping cycle to allow the pistons to rotate in mutual contact and to reduce compression between them.

According to one aspect of the instant invention, the first and the second variable offset transmission means each comprise a slide member which carries the associated piston. The slide member is slidably engaged with the associated rotating drive means to allow the slide member to rotate the piston in response to the rotation of the rotating drive means and to vary the offset of the piston by sliding in relation to the rotating drive means. The variable offset transmission means may comprise a fixed cam having a semi-elliptical portion to provide a positive cam action for changing the position of the slide member in response to rotation by the rotating drive means.

According to another aspect of the instant invention the variable offset transmission means may comprise an extensible crank attached between a piston and a rotating drive means and may further comprise at least one of a fixed cam for determining the degree of extension of the crank and a biasing means for biasing the crank to bear against the cam.

The variable offset transmission means according to this invention may comprise biasing means to urge the slide member against the fixed cam. Alternately, the fixed cam may be an offset split cam which may have a first cam surface and a second cam surface to provide both increasing offset and decreasing offset. The first and second cam surfaces may each comprise a semicircular portion and a semi-elliptical portion in which the minor axis of a semi-elliptical portion equals the diameter of its associated semicircular portion. The slide member or crank comprises at least one cam follower to bear against the fixed cam.

According to another aspect of this invention, the interior walls of the chambers may each have a semicircular chamber portion and a semi-elliptical chamber portion, and the semi-elliptical chamber portions may have as their minor axes the diameter of their associated semicircular chamber portion.

In a pump according to the instant invention the direction of rotation of the pistons about their drive axes of rotation may be reversible. The pump may comprise check valve means interposed in the fluid flow path to prevent back flow through the pump. The check valve means may be switchable between first and second conditions to accommodate fluid flow through the fluid flow path in opposite directions. The pump may comprise automatic check valve switching means to reverse the check valve means in response to a reverse in the pumping direction.

In another aspect of the present invention, the pistons may comprise counterbalance means disposed within the pistons to reduce vibrations during use.

As used in this specification and in the claims, the term "semi-elliptical" does not necessarily refer to a contour which follows the strict mathematical definition of an ellipse, but rather is intended to refer to an ovoid contour which differs from a circle in the manner described herein below.

As used herein, the term "oblique position" refers to the position of pistons when their respective centers are at the point of greatest deviation from the centerline of the pump.

As used herein, the term "aligned position" refers to the position of the pistons when their respective centers are disposed along the centerline of the pump. The "distal aligned position" is the aligned position in which the piston is farthest from the passage between the chambers, and the "proximal aligned position" is the aligned position in which the piston protrudes into the passage between the chambers.

As used herein and in the claims, the term "semi-elliptical chamber" refers to a chamber having a semicircular portion and a semi-elliptical portion, as described below.

DETAILED DESCRIPTION OF THE INVENTION AND PREFERRED EMBODIMENTS THEREOF

Figure 1:
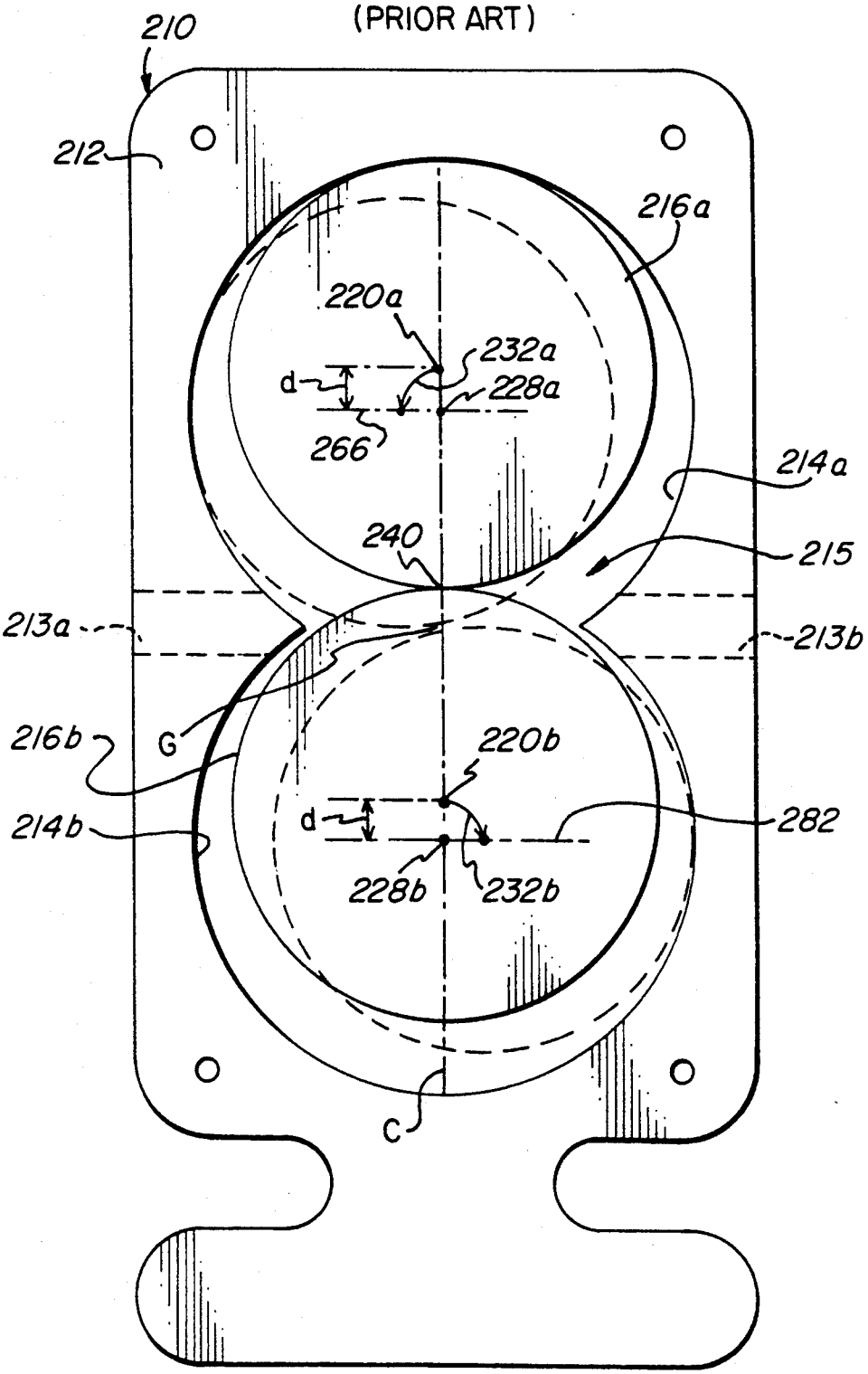
FIG. 1 (PRIOR ART)
FIG. 1 is a schematic elevational view of a pump according to the prior art with the face plate removed.

There is shown in FIG. 1 a double piston pump 210 according to the prior art with the face plate removed. The prior art pump includes a housing 212 which defines a pump cavity having two cylindrical chambers 214*a* and 214*b* which intersect to form a passage 215 therebetween, and which further defines an inlet port 213*a* and an outlet port 213*b* each in flow communication with the chambers to accomplish fluid flow through housing 212. Disc-shaped pistons 216*a* and 216*b* having center points 220*a* and 220*b*, respectively, (indicated by cross hairs) are mounted within cylindrical chambers 214*a* and 214*b*, respectively. Each piston is driven by a drive shaft (not shown) having a drive axis of rotation 228*a*, 228*b*, respectively. In FIG. 1, drive axes of rotation 228*a* and 228*b* are seen as points which are vertically aligned and together establish a vertical centerline C of the pump. When pistons 216*a* and 216*b* are positioned with their respective center points 220*a* and 220*b* on centerline C, they are said to be in an "aligned" position. Pistons 216*a* and 216*b* are coupled to their respective drive means so that their center points 220*a* and 220*b* are offset by distance d from the drive axes of rotation 228*a* and 228*b* and the rotation of the drive means causes pistons 216*a* and 216*b* to rotate or orbit about the drive axes of rotation with a constant eccentricity or offset equal to distance d.

Pistons 216*a* and 216*b* are positioned in mutual tangential contact at piston-piston contact point 240 when in the aligned position, as shown.

The respective drive means (not shown) rotate pistons 216*a* and 216*b* in opposite directions about drive axes of rotation 228*a* and 228*b*, respectively, so that center points 220*a* and 220*b* move in the direction of arrows 232*a* and 232*b* with equal angular velocity about their respective drive axes of rotation. As a result, during rotation the pistons 216*a*, 216*b* undergo relative translational movement about their respective axes of rotation. During such movement, the center points of pistons 216*a* and 216*b* will simultaneously move downwardly as sensed in FIG. 1 along centerline C while also moving away from centerline C in opposite directions, piston 216*a* moving to the left and piston 216*b* moving to the right. Since center points 220*a* and 220*b* are thus moving away from each other, the pistons can no longer remain in mutual tangential contact and a gap will occur between them. The gap G will be at its maximum when the center points of the pistons are at their maximum deviation from centerline C, i.e., when pistons 216*a* and 216*b* have rotated ninety degrees from the positions shown in solid line to the positions shown in dotted outline in FIG. 1, where center points 220*a* and 220*b* lie on horizontal reference abscissas 266 and 282, respectively. At this point, the pistons are described as being in oblique positions and the gap G is at its greatest width. As rotation continues, center points 220*a* and 220*b* of pistons 216*a* and 216*b* once again begin to approach centerline C, and gap G diminishes.

If, to avoid this gapping phenomenon, larger pistons are used so that they are in mutual tangential contact even in oblique positions, subsequent rotation as described above will produce a compression between the pistons as the center points approach centerline C and each other on further rotation.

To remedy the gapping and compression problems discussed above with respect to the prior art, a pump according to the present invention comprises variable offset transmission means to vary the rotational offset, i.e., the orbital eccentricity, of the pistons as they proceed through each cycle of rotation. Thus, the pistons may be in contact in the oblique position, and may rotate further without compression. The chambers enclosing the pistons are dimensioned and configured to accommodate the new orbital path of the pistons without gapping or compression between the piston and the chamber wall.

Figure 2A:
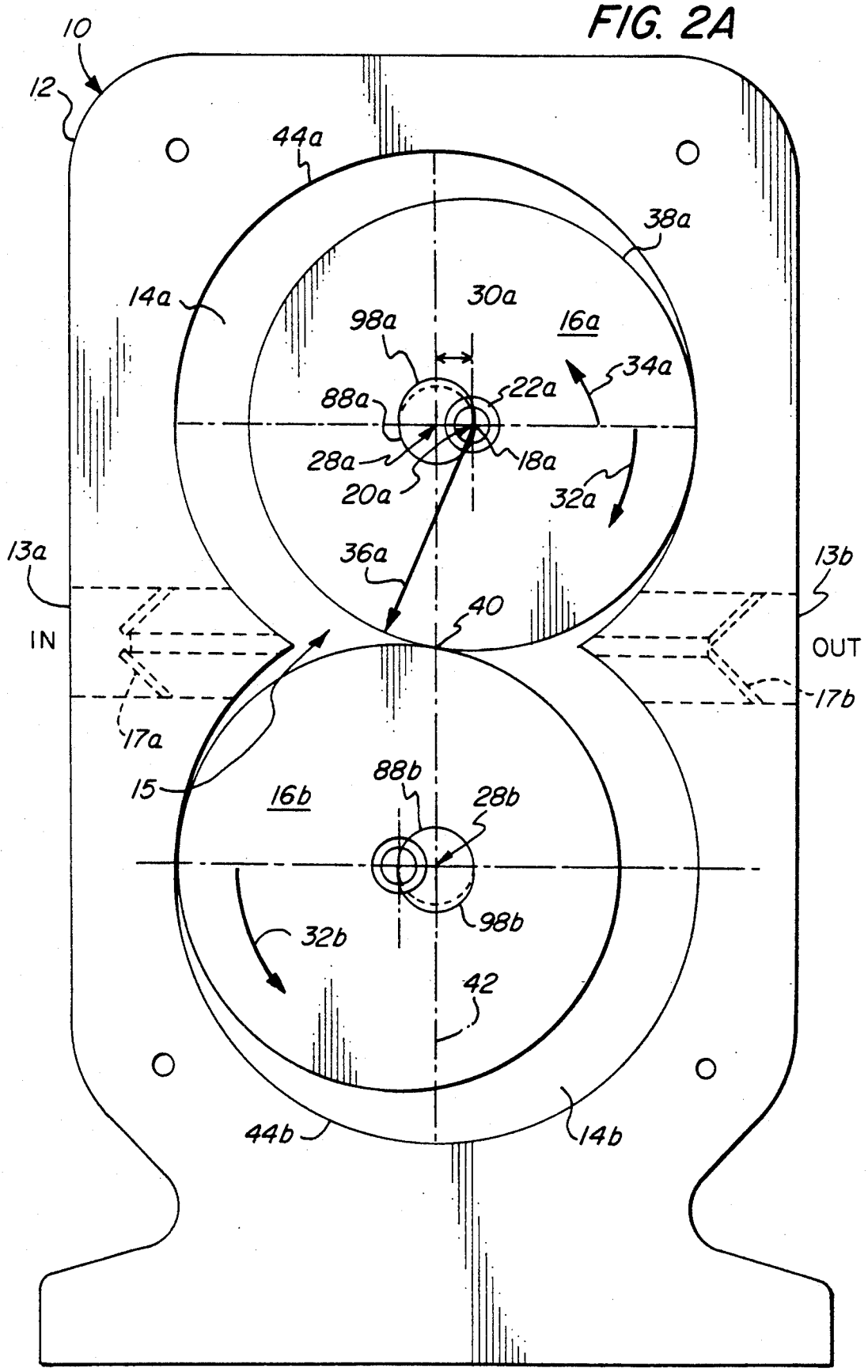
FIG. 2A is a schematic elevational view of one embodiment of a pump according to the present invention with the face plate removed.

Accordingly, there is shown in FIG. 2A a pump 10 according to this invention comprising a housing 12 defining a pump cavity having an inlet port 13*a* and outlet port 13*b* to establish a fluid flow path through the pump, and two generally disc-shaped chambers 14*a* and 14*b* whose peripheral walls intersect to form a passage 15 therebetween. Ports 13*a* and 13*b* are equipped with check valves 17*a* and 17*b* in the fluid flow path to prevent backflow through housing 12. Within chamber 14*a* is mounted a disc-shaped piston 16*a*, and within chamber 14*b* is mounted a like piston 16*b*. In this embodiment, the longitudinal axis of chamber 14*a* is parallel to the longitudinal axis of chamber 14*b*, and the disc-shaped pistons and chambers are generally cylindrical. It will be understood, however, that the chambers and pistons in a pump according to this invention need not be cylindrical. For example, if the longitudinal axes of the pistons (and chambers) lie in a common plane but are not mutually parallel, the pistons (and chambers) may have the general shape of a frustum.

Since the pump illustrated is symmetrical with respect to the construction of the cylinders, pistons and other elements to be described in each cylinder, this description will focus on the top cylinder and piston as shown in FIG. 2A, but it should be understood that this description applies equally to the other half of the pump, with corresponding structures in and around the two generally cylindrical chambers having like numbers and complementary letters "a" and "b", e.g., 14*a* being the upper chamber and 14*b* being the lower chamber.

Piston 16*a* is mounted on a piston spindle 18*a* which is circular in cross section and concentric at center point 20*a* with the center of piston 16*a*. Between piston spindle 18*a* and piston 16*a* is a bearing 22*a* which allows piston 16*a* to be freewheeling, i.e., to rotate with little friction, clockwise or counterclockwise, about piston spindle 18*a*. A rotating drive means such as drive shaft 26*a* (shown in FIG. 2B) is coupled to piston spindle 18*a* by a transmission means described below, to rotate piston 16*a* within chamber 14*a*. Drive shaft 26*a*, which may be driven manually or by machine, establishes a drive axis of rotation 28*a* parallel to the longitudinal axis of chamber 14*a* about which piston 14*a* orbits. Piston spindle 18*a* is off-center from drive axis of rotation 28*a* by a distance referred to herein as the "piston offset" and represented in FIG. 2A by arrow 30*a*. Therefore, when drive shaft 26*a* rotates piston 16*a* about drive axis of rotation 28*a*, center point 20*a* (which represents the centers of both piston spindle 18*a* and piston 16*a*) rotates about drive axis of rotation 28*a* in an orbit having an offset equal in length to arrow 30*a*. The rotating drive means for piston 16*b* may be a drive shaft similar to drive shaft 26*a* or some other drive such as a drive gear driven with or from drive shaft 26*a*. Chamber 14*a* is designed so that radius 36*a* of piston 16*a* is sufficient to allow tangential contact of piston 16*a* with the wall of chamber 14*a* during the course of its rotation. Since piston 16*a* is free to rotate about piston spindle 18*a*, the rotation of drive shaft 26*a* in the direction of arrow 32*a* impels piston 16*a* to roll or "walk" around the inside wall of chamber 14*a*, thus imparting a rotation to piston 16*a* in the direction of arrow 34*a* about center point 20*a*. The pump is reversible in that by reversing the direction of rotation, the direction of fluid flow is reversed. This device may thus be used as a pump or as a compressor for liquids or gases. Fluid is contained in chambers 14*a* and 14*b* by securing face plates (not shown) to the front and rear of the pump, in a conventional manner. The front face plate may completely cover and seal the open chamber, whereas the rear face plate has an opening large enough to accommodate the drive means (i.e., drive shaft 26*a*) but small enough to seal the chambers between housing 12 and pistons 16*a* and 16*b*.

FIG. 2A shows pistons 16*a* and 16*b* in oblique positions and in mutual, tangential piston-piston contact at point 40. As piston 16*a* rotates about drive axis of rotation 28*a* in the direction of arrow 32*a*, the piston offset will remain constant until piston 16*a* has rotated 180°, including 90° to the proximal aligned position and a further 90° to the second oblique position which occurs within a single 360° pumping cycle.

As discussed above, if, while piston 16*a* moves in the semicircle from the oblique position shown to the opposing oblique position, piston 16*b* rotates about its drive axis of rotation 28*b* with a constant offset, center point 20*a* of piston 16*a* and the center point of piston 16*b* will approach one another along centerline 42 of pump 10, resulting in compression between the cylinders at piston-piston contact point 40. To alleviate this compression and to avoid the need for one or both of the pistons to be made from compressible material or to at least be covered with compressible material, the present invention provides that the offset of piston 16*b* increases while piston 16*b* rotates 180° from the oblique position through the distal aligned position to the opposing oblique position. To accommodate this varying offset, the contour of chamber 14*b* differs from the chambers of the prior art to provide a semi-elliptical surface 44*b* which allows piston 16*b* to travel beyond the constraints of a purely cylindrical chamber as taught in the prior art. Thus, while piston 16*a* travels clockwise in a semicircular orbit about drive axis of rotation 28*a* from the oblique position shown in FIG. 1 through the proximal aligned position to the opposing oblique position, piston 16*b* travels in a semi-elliptical orbit about its drive axis of rotation. Conversely, when piston 16*b* rotates in the counterclockwise direction indicated by arrow 32*b* from the oblique position which is 180° from the position shown in FIG. 1 through its proximal aligned position to the oblique position shown, this portion of its rotation will be semicircular and have a constant offset from its drive axis of rotation. The corresponding rotational path of piston 16*a*, however, will be altered by varying the offset to avoid compression as was the rotation of piston 16*b* described above. To synchronize the rotations of the first and second pistons, the respective drive means are synchronized, e.g., by timing gears. Thus, the piston offset of each piston is constant through part of the rotation about its drive axis of rotation, and varies in the other part. Like chamber 14*b*, chamber 14*a* is partially elliptical to accommodate the varying offset of the rotation of piston 16*a*.

To accomplish the varying offset described above, this invention comprises variable offset transmission means to rotate pistons 16*a* and 16*b* about drive axes of rotation 28*a* and 28*b* (not shown) and to change the offset of piston spindles 18*a* and 18*b* from drive axes of rotation 28*a* and 28*b* during part of the course of a full rotation as described above.

Figure 2B:
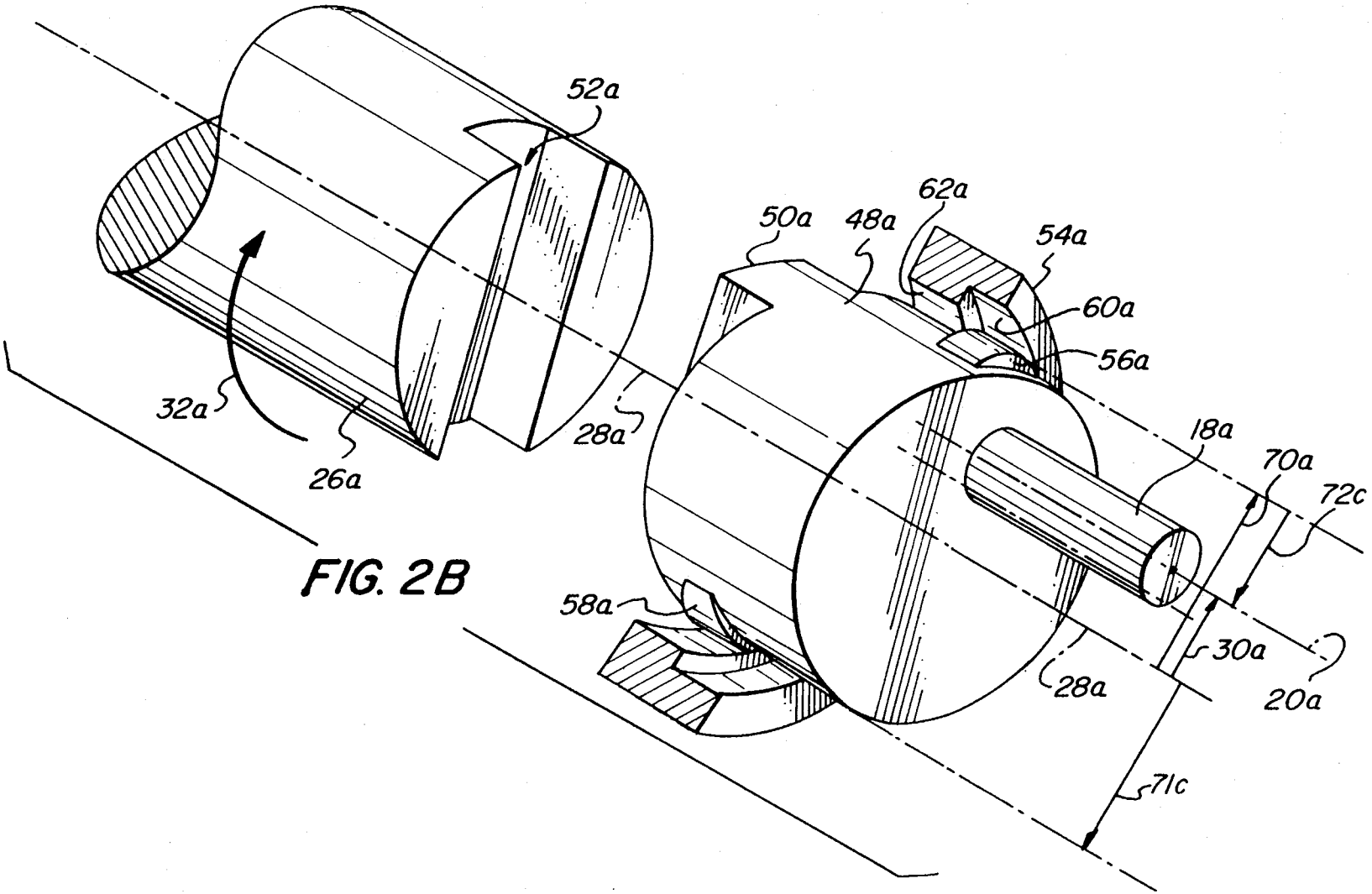
FIG. 2B is an exploded perspective view partly in cross section of a variable offset transmission means utilizable in the pump of FIG. 1 and comprising in the illustrated embodiment a fixed cam according to this invention.

The variable offset transmission means comprises a slide member 48*a*, FIG. 2B, which carries piston spindle 18*a* on which piston 16*a* may be mounted. Slide member 48*a* is equipped with a tongue 50*a*, and drive shaft 26*a* is equipped with groove 52*a* to slidably receive tongue 50*a*. When tongue 50*a* is disposed within groove 52*a*, the rotation of drive shaft 26*a* about drive axis of rotation 28*a* will cause slide member 48*a* and piston spindle 18*a* to rotate. As discussed above, center point 20*a* of piston spindle 18*a* is offset from the drive axis of rotation 28*a* as indicated by arrow 30*a*. In addition to transmitting the driving rotational force, the tongue-in-groove configuration allows slide member 48*a* to slide within groove 52*a* during the course of a rotation, thereby allowing a change in the magnitude of the piston offset represented by arrow 30*a*. To allow for changes in the piston offset, tongue 50*a* is disposed longitudinally parallel to the piston offset. Therefore, when tongue 50*a* is disposed within groove 52*a*, piston spindle 18*a* can both rotate in response to the rotation of drive shaft 26*a* and can simultaneously provide radial variations in the piston offset. In an alternative embodiment, the drive shaft may carry the tongue and the slide member may be equipped with a corresponding groove.

To control the sliding motion of slide member 48*a* in groove 52*a* the variable offset transmission means according to this invention includes a fixed cam 54*a* (shown for clarity in partial cross section) which surrounds slide member 48*a* to define its position in relation to drive axis of rotation 28*a* during the course of a full 360° rotation. Fixed cam 54*a* is disposed in fixed relation to drive axis of rotation 28*a* and for this purpose may be mounted wherever appropriate, for example, it may be attached to housing 12. Fixed cam 54*a* functions as a split cam having two offset cam surfaces, first cam surface 60*a* and second cam surface 62*a*. To facilitate the function of fixed cam 54*a*, slide member 48*a* is equipped with a first follower member 56*a* which bears against first cam surface 60*a*, and a second follower member 58*a* which bears against second cam surface 62*a*. Second follower member 58*a* is radially opposed and axially set off from first follower member 56*a*. Follower members 56*a* and 58*a* may be polished protrusions from the surface of slide member 48*a* or may be rollers or bearings mounted in slide member 48*a*.

As shown in FIG. 2B, piston spindle 18*a* and piston 16*a* (not shown) are in the distal aligned position. As discussed above, this means that piston 16*a*, the position of which is identified with respect to center point 20*a*, is at the apex of the semi-elliptical portion of its orbit where the piston offset is at its greatest magnitude. As drive shaft 26*a* rotates piston spindle 18*a* ninety degrees in the direction of arrow 32*a*, piston 16*a* (not shown) will approach the oblique position, with the piston offset diminishing until, in the oblique position, the piston offset is equal once again to the original semicircular radius, and thence remains constant for the subsequent 180° of rotation.

Figure 2C:
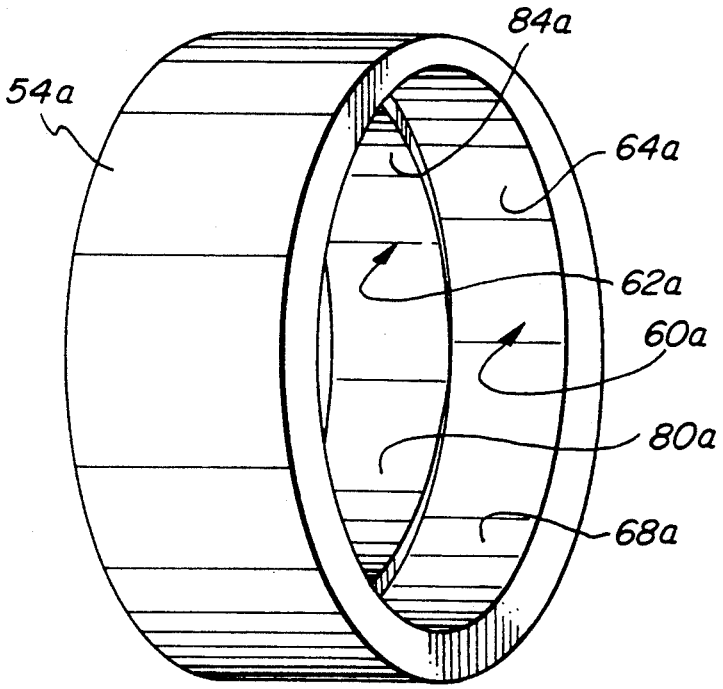
FIG. 2C is a perspective view of the fixed cam of FIG. 2B.

Fixed cam 54*a* is shown in its entirety in FIG. 2C, where its annular configuration and the offset relationship of surfaces 60*a* and 62*a* are illustrated. The contours of surfaces 60*a* and 62*a* are described with respect to FIGS. 3 and 4, respectively.

To achieve the varying offset described above, first cam surface 60*a*, as shown in FIG. 3, has two distinct portions, which are described in reference to reference abscissa 66*a*. The two distinct portions are a semi-elliptical portion 64*a* spanning quadrants I and IV above reference abscissa 66*a*, and semicircular portion 68*a* in quadrants II and III beneath reference abscissa 66*a*. Together, semi-elliptical portion 64*a* and semicircular portion 68*a* are configured to alternately determine and accommodate the necessary travel of first follower member 56*a*, also shown in FIG. 2B, to produce the varying offset effect discussed above.

Due to the construction of slide member 48*a* and first follower member 56*a* thereon, and because first follower member 56*a* bears against first cam surface 60*a*, it is necessary to define the first follower offset as the distance from drive axis of rotation 28*a* to the point of contact of first follower member 56*a* with fixed cam 54*a*, indicated by arrow 70*a*, FIG. 2B. The first follower offset is the sum of the piston offset indicated by arrow 30*a* and the follower margin, which is the distance from the center point 20*a* to the point of contact of first follower member 56*a* with fixed cam 54*a*, indicated by arrow 72*a*. Since the follower margin is fixed and does not vary, the first follower offset varies with the piston offset. Likewise, the second follower offset, the distance from drive axis of rotation 28*a* to the point of contact of second follower member 58*a* with second cam surface 62*a*, indicated by arrow 71*a*, varies inversely with the piston offset.

Figure 3:
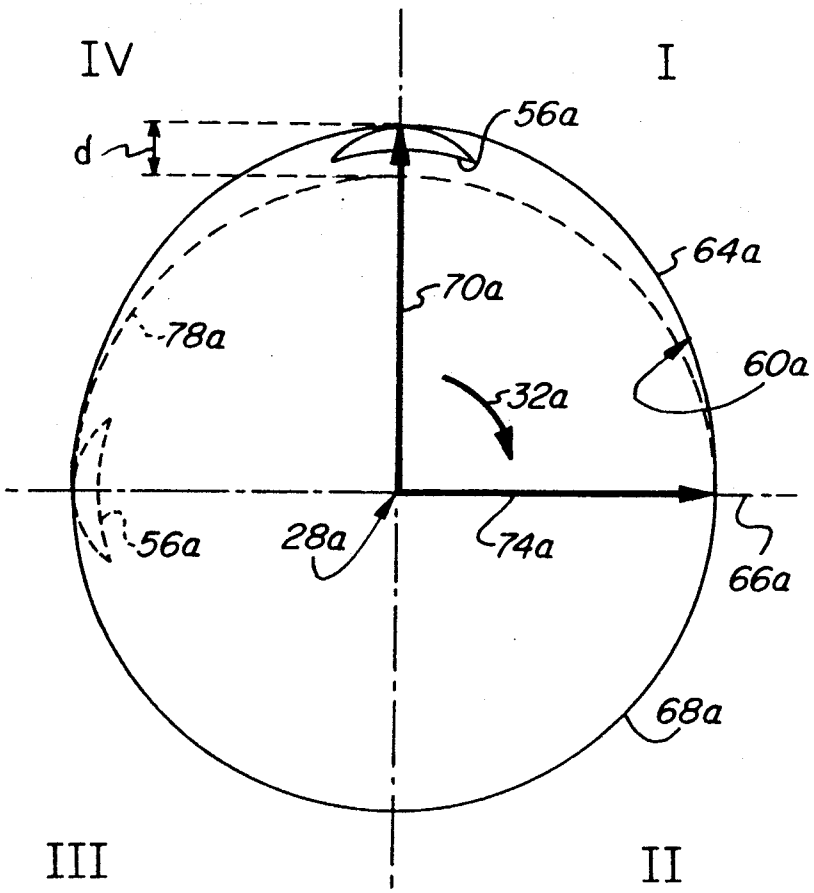
FIG. 3 is a schematic elevational view of the first cam surface of the fixed cam of FIG. 2C showing the relationship thereto of the cam follower of FIG. 2B.

In the distal aligned position shown in FIG. 3, first follower member 56*a* bears upon the semi-elliptical portion 64*a* of first cam surface 60*a* with a first follower offset 70*a* from drive axis of rotation 28*a*. The first follower offset, represented in FIG. 3 as arrow 70*a*, is the distance from axis of rotation 28*a* to the point on first cam surface 60*a* where first follower member 56*a* makes tangential contact with first cam surface 60*a*, and for descriptive purposes can be considered the radius of first cam surface 60*a* at the contact point, measured from drive axis of rotation 28*a*. In the position shown, the first follower offset is at a maximum magnitude. As discussed previously, as piston 16*a* rotates about drive axis of rotation 28*a* ninety degrees in the direction of arrow 32*a*, the first piston offset decreases. This occurs because, in quadrant I, the radius of semi-elliptical portion 64*a* decreases by degrees until it is equal to radius 74*a* of semicircular portion 68*a*, causing slide member 48*a* to slide within groove 52*a*, thereby bringing center point 20*a* (FIG. 2) closer to drive axis of rotation 28*a*.

Due to the geometrical relationship between semi-elliptical portion 64*a* and semicircular portion 68*a*, radius 74*a* of semicircular portion 68*a* represents one half of the minor axis of semi-elliptical portion 64*a*. The difference between the cam radius at the apex of semi-elliptical portion 64*a* (i.e., the length of arrow 70*a*) and the radius at any point in semicircular portion 68*a* (mirrored for clarity in quadrants IV and I as dotted curve 78*a*) is designated as d in FIG. 3, which will be understood to decrease as first follower member 56*a* rotates through quadrant I.

After first follower member 56*a* proceeds 90° in the direction of arrow 32*a* (i.e., to the oblique position), it comes to bear against semicircular portion 68*a* of first cam surface 60*a*. Semicircular portion 68*a* will not change the first follower offset during the course of the next 180° of rotation through quadrants II and III because the radius of semicircular portion 68*a* of cam surface 60*a* is constant.

As first follower member 56*a*, as shown in dotted outline (FIG. 3), leaves the semicircular portion of its rotation path from quadrant III, it is free to move beyond radius 74*a* of semicircular portion 68*a* and thus travel in a semi-elliptical path extending beyond the complementary semicircular path 78*a* (shown in dotted outline) it would otherwise travel. If first follower member 56*a* were to follow first complementary semicircular path 78*a*, the first follower offset would be constant throughout the rotation, as would the piston offset, and the advantage of this invention would be lost. Therefore, some mechanism is required to insure that slide member 48*a*, FIG. 2B, to which first follower member 56*a* is attached, slides within groove 52*a* to increase, by degrees, the offset of first follower member 56*a*, FIG. 3, as it follows semi-elliptical portion 64*a* through quadrant IV toward the distal aligned position shown in FIG. 3. To provide the necessary outward sliding motion, second follower member 58*a*, which is radially opposed to and axially offset on slide member 48*a* from first follower member 56*a*, bears upon second cam surface 62*a* as shown in FIGS. 2B, 2C and FIG. 4.

Second cam surface 62*a* has a semi-elliptical portion 80*a* spanning quadrants II and II beneath reference abscissa 82*a* and semicircular portion 84*a* spanning quadrants IV and I above reference abscissa 82*a*. Semi-elliptical portion 80*a* is smaller than semicircular portion 84*a*, with the radius of semicircular portion 84*a* being the major axis of semi-elliptical portion 80*a* rather than the minor axis as was the case for first cam surface 60*a*.

Figure 4:
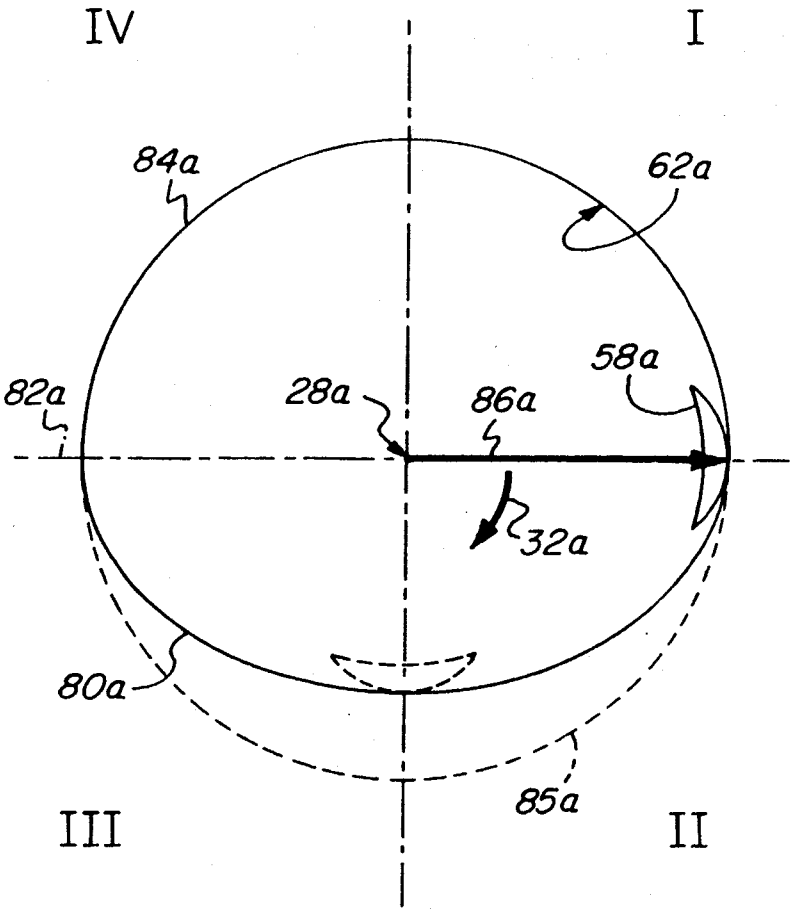
FIG. 4 is a schematic elevational view of the second cam surface of the fixed cam of FIG. 2C showing the relationship thereto of the cam follower of FIG. 2B.

While first follower member 56*a* is entering quadrant IV of FIG. 3 and is in need of an outward force to bear against semi-elliptical portion 64*a*, second follower member 58*a* (also seen in FIG. 2B) is entering quadrant II of FIG. 4, where it bears upon semi-elliptical portion 80*a* of second cam surface 62*a*. In quadrant II, semi-elliptical portion 80*a* decreases by degrees the second follower offset (represented by arrow 71*a*, FIG. 2B) of second follower member 58*a* thus pushing slide member 48*a* (FIG. 2B) within groove 52*a* and forcing first follower member 56*a* to follow semi-elliptical path 64*a* in quadrant IV of FIG. 3. When second follower member 58*a* reaches the smallest radius of its travel (at the point on semi-elliptical portion 80*a* between quadrants II and III where second follower member 58*a* is shown in dotted outline), first follower member 56*a* is pushed to its greatest offset, in the position shown in solid line in FIG. 3. At this point, the deviation of the radius of semi-elliptical portion 80*a* from the radius of semicircular portion 84*a* (reproduced for clarity in quadrants III and II as dotted line 85*a*) is at its greatest and is the same deviation d shown in FIG. 3. As drive member 26*a* continues to rotate, semi-elliptical portion 80*a* of second cam surface 62*a* can no longer push second follower 58*a* because the radius of the semi-elliptical portion 80*a* increases in quadrant III. However, while second follower member 58*a* is in quadrant III, first follower member 56*a* is in quadrant I, FIG. 3, where, as discussed above, its offset decreases, pushing slide member 48*a* toward a lesser offset, and keeping second follower member 58*a* against semi-elliptical portion 80*a* despite the increasing radius. The offset surfaces of fixed cam 54*a* thus provide a positive cam action to alternately increase and decrease the offset represented by arrow 30*a* by sliding slide member 48*a* within groove 52*a*.

Fixed cam 54*a* functions as a split cam because only part of each cam surface 60*a* and 62*a* provides a positive action to vary the piston offset as described above; no change in piston offset is effected by semicircular portions 68*a* and 84*a*. Specifically, the portion of semi-elliptical surface 80*a* spanning quadrant II of FIG. 4 increases the piston offset of piston 16*a*, and the portion of semi-elliptical portion 64*a* spanning quadrant I of FIG. 3 decreases the piston offset of piston 16*a*. In this embodiment, then, the semi-elliptical portion of fixed cam 54*a* which provides the positive cam action is split between two axially offset surfaces 60*a* and 62*a*.

Figure 5A:
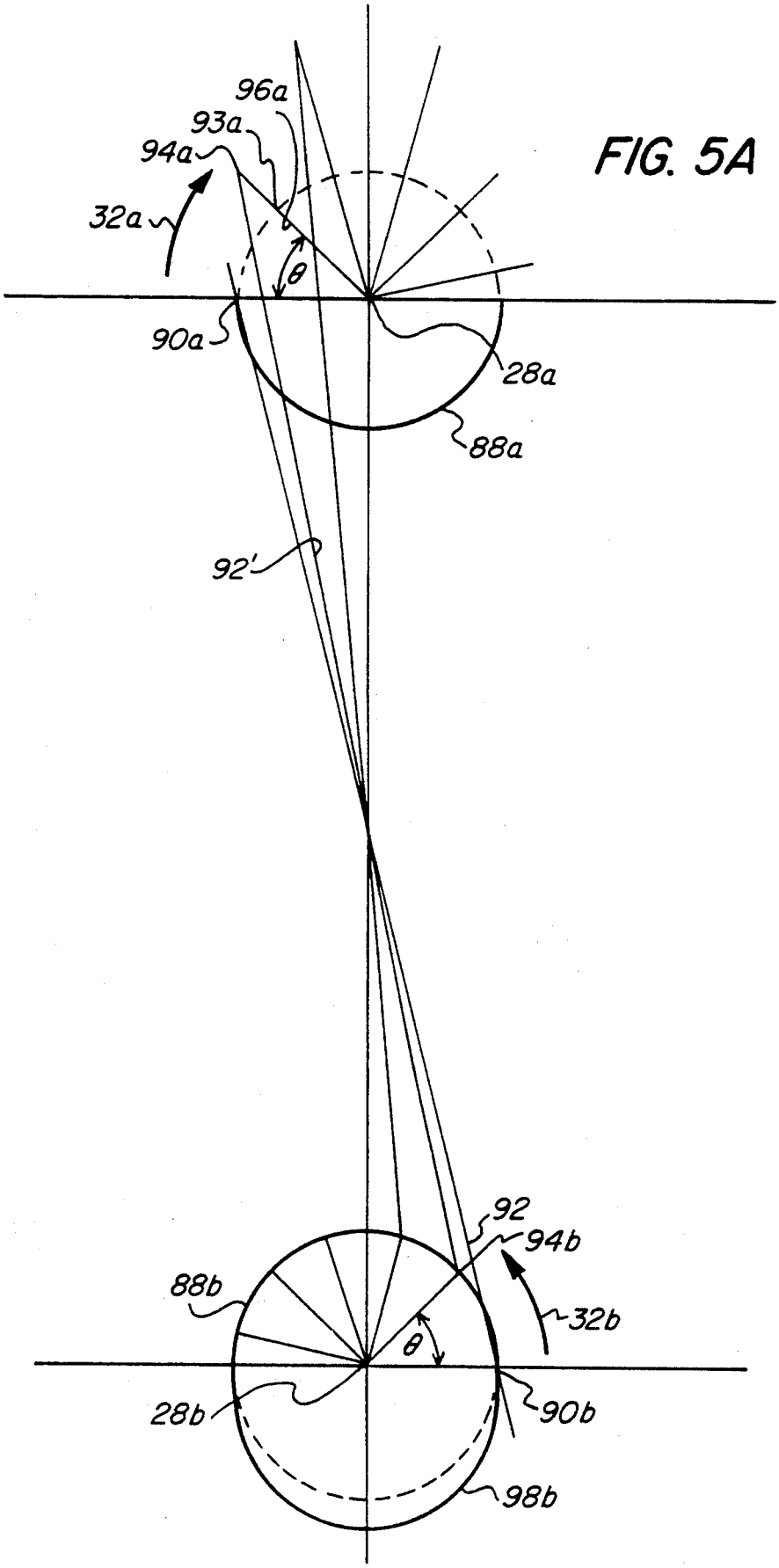
FIG. 5A is a diagram illustrating a method for generating a semicircular, semi-elliptical path for a pump according to the present invention.

The precise configurations of semi-elliptical portions 64*a* and 80*a* of first cam surface 60*a* and second cam surface 62*a*, respectively, are designed to provide the variable offset described above while the pistons rotate and remain in mutual tangential contact without gapping or compression. The shape of the orbit in which the center of the pistons must travel can be determined graphically as shown in FIG. 5A, in which semicircular piston paths 88*a* and 88*b* (also shown in FIG. 2A) represent the proximal portions of the paths of piston center points 20*a* and 20*b*, respectively. As discussed above, pistons which are in tangential contact have a determinable distance between their centers, and to avoid gapping or compression during rotation, this intercenter distance must remain constant. To determine the elliptical portion of the travel of center point 20*a* as it moves about drive axis of rotation 28*a*, one should assume the pistons to be in their mutually oblique positions with centers at points 90*a* and 90*b*, respectively, at which point pistons 16*a* and 16*b* are in tangential contact and their respective centers are separated by a fixed inter-center distance 92. Then, project the orbit of piston 16*b* about drive axis of rotation 28*b* in the direction of arrow 32*b* in a fixed angular increment $\theta_1$ to position 94*b*, with a corresponding angular rotation of $\theta_1$ of center 20*a* in the direction of arrow 32*a*. Prior art mechanisms would attempt to place center 20*a* at point 93*a*, a position at which the inter-center distance is reduced with corresponding compression between the pistons. According to this invention, however, the inter-center distance 92, now represented by connecting chord 92', is preserved by the variable offset transmission means described above, which increases the offset of piston 16*a*. An extension of radial chord 96*a* to a point 94*a* which is equally distant from point 94*b*, i.e., at the end of connecting chord 92', establishes the new position of center point 20*a* of piston 16*a* for that given increment of rotation.

Figure 5B:
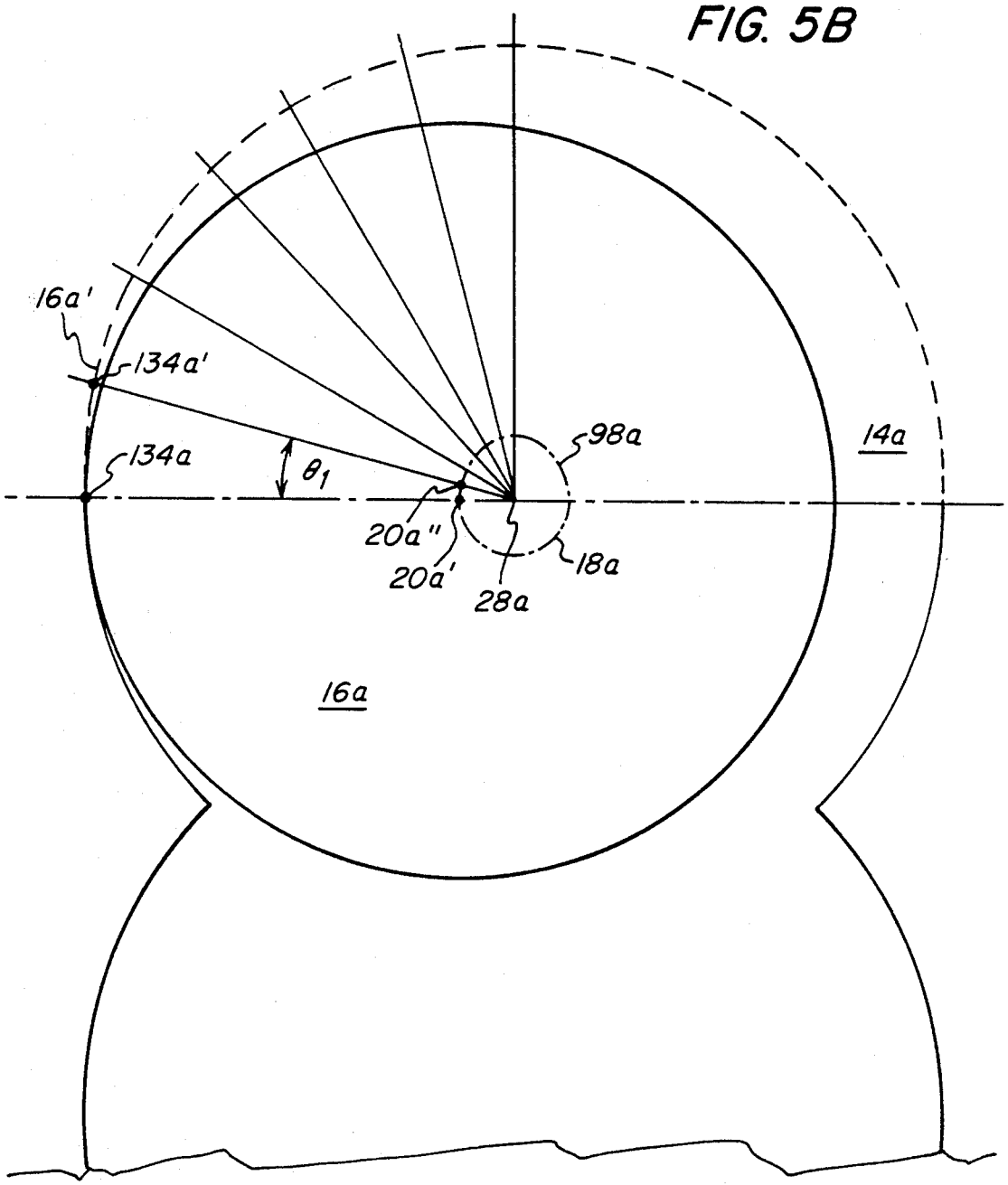
FIG. 5B is a diagram illustrating a method for generating a semicircular, semi-elliptical chamber wall for a pump according to this invention.

The position of piston 16*a* at each progressive increment determines the configuration which chamber 14*a* must have to provide for tangential, noncompressing contact with piston 16*a*. As shown in FIG. 5B, piston 16*a* is in the oblique position signified by center point 20*a'*, which corresponds to point 90*a* of FIG. 5A. In this position, chamber 14*a* must meet piston 16*a* in tangential contact at a point 134*a* which is the most remote point on piston 16*a* from drive axis of rotation 28*a*. During the angular incremental rotation $\theta_1$, piston center point (20*a'*) moves along semi-elliptical path 98*a* (also shown in FIG. 2A) to point 20*a''*. For clarity, only the most distal portion of piston 16*a*, indicated as 16*a'*, is shown in this and in succeeding positions. Chamber 14*a* must be configured to touch piston 16*a* at remote point 134*a*'. By projecting a number of such increments, a generatrix can be produced by tracing the most distant portions of piston 16*a* as it travels through the semi-elliptical portion of its rotation, to define semi-elliptical chamber portion 44*a*. FIG. 2A, which differs from the circular contour of cylindrical chambers of the prior art to accommodate the increased offset of piston 16*a* according to this invention. A complementary process is performed for piston 16*b* and chamber 14*b* when piston 16*a* travels on semicircular path 88*a*, establishing semi-elliptical path 98*b* (also shown in FIG. 2A) of center 20*b* (not shown), which similarly extends beyond the prior art semicircular path (shown in dotted outline.)

The required distance at each angular increment from drive axis of rotation 28*a* to the semi-elliptical chamber wall according to this invention determines the configuration of the cam surfaces 60*a* and 62*a* of fixed cam 54*a* by dictating the degree of departure of semi-elliptical cam portions 64*a* (FIG. 3) and 80*a* (FIG. 4) from a circular configuration (i.e., the variance in offset at that angle, previously designated deviation d). The radius of the semicircular cam portions 68*a* and 84*a* are chosen to accommodate slide member 48*a* and follower members 56*a* and 58*a*, and to provide a smooth transition between the semicircular and semi-elliptical portions. To foster a smooth transition, the radius of the semicircular portion should be significantly larger than the maximum deviation d in the semi-elliptical portion.

While the foregoing embodiment is preferred, it is not necessary that the fixed cam be a split cam. For example, it is possible to provide a single cam surface and a single follower member on the slide member, provided that the variable offset transmission means includes some means for assuring the follower will bear against the cam surface during all portions of the rotation, regardless of whether the offset increases or decreases. In such case, the semi-elliptical portion of the fixed cam which provides a positive cam action is disposed on a single cam surface. This may be accomplished, for example, where the groove in the variable offset transmission means is a closed-end groove in which there is a spring to bear against the side of the tongue when it is disposed in the groove. The spring may force the slide member radially outward so that the single follower member, radially opposed from the spring, bears against the single cam surface at all times. In an alternative embodiment, the variable offset transmission means includes an extensible crank attached to the drive member at one end and the cam piston at the other end, thus providing an offset. The crank may include biasing means such as a spring to bias the crank toward extension and may further include a follower member. In this embodiment, the variable offset transmission means includes a cam against which the follower member bears to vary the offset as required.

According to another aspect of this invention, the fixed cam may provide a circuitous slot for engaging a follower to determine the offset of the piston without the need for a split cam or biasing means.

Since each piston faces the same offset constraint, the rotating drive means of each are synchronized by timing gears to assure a one-to-one angular rotation at all times.

Preferably, the pistons include a resilient outer surface which is resistant to wear and which facilitates sliding contact between the pistons as they rotate. The thickness of the resilient coating is included in the diameter of the piston for purposes of determining the shape of the elliptical portion of the rotation path.

Figure 6:
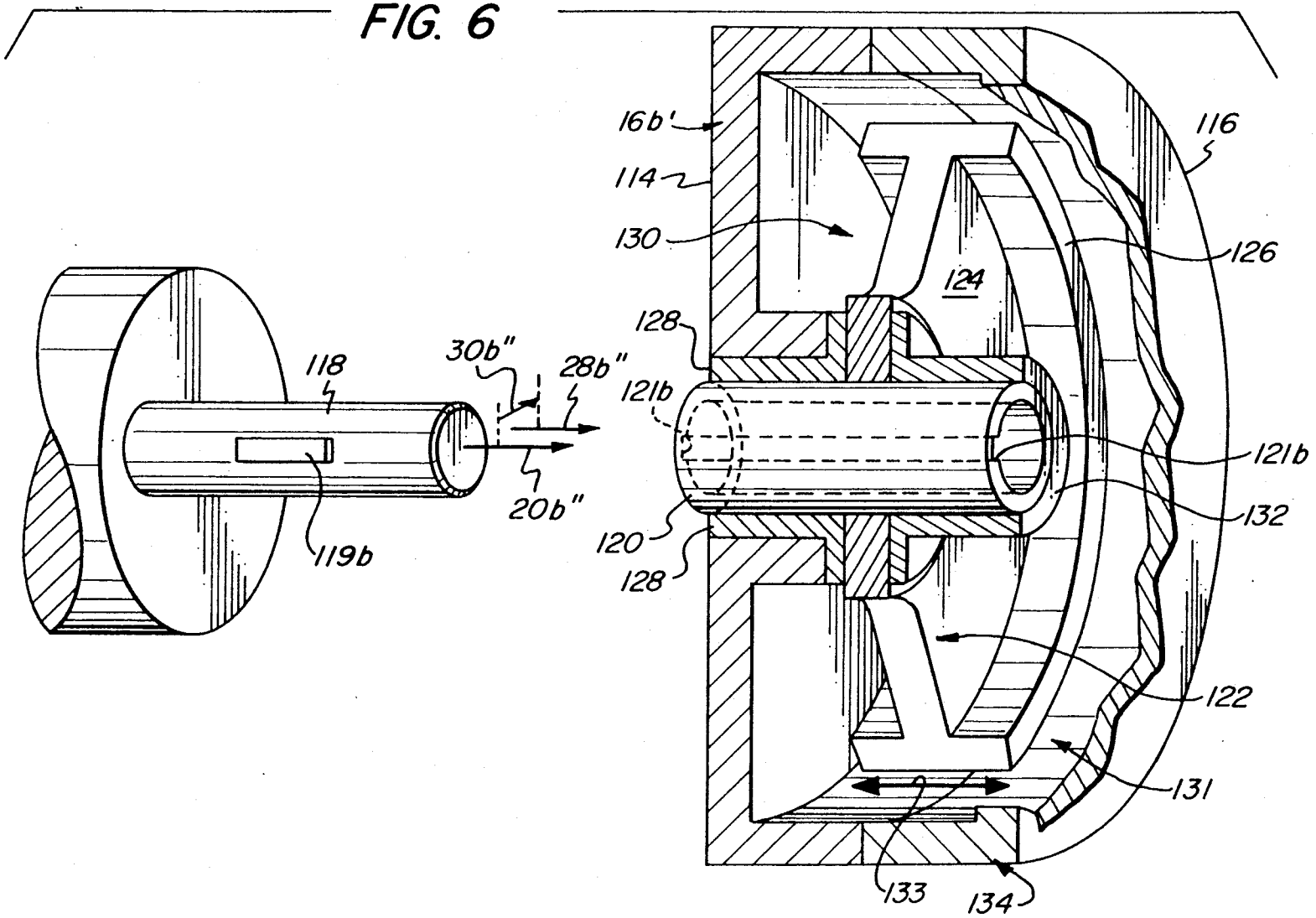
FIG. 6 is a partly exploded, partly cross-sectional perspective view of a counterbalanced piston utilizable in a pump according to one embodiment of the present invention.

Since the cylindrical pistons rotate about a point which is not coincident with their respective centers of gravity, vibrations may occur. To ameliorate these vibrations, pistons according to this invention may comprise a counterbalance to more evenly distribute the total piston mass about the drive axis of rotation. This may be accomplished by constructing each piston from two circular plates which define an annular void between them as shown in FIG. 6 where piston 16*b*' comprises inner piston half 114 (shown in partial cross section) and outer piston half 116 (shown in partial broken cross section, for clarity). Piston 16*b*' is shown in an oblique position similar to that of piston 16*b* of FIG. 2A, evidenced by the horizontal orientation of the piston offset indicated by arrow 30*b*''. Piston spindle 118 is equipped with a key 119*b* and collar portion 120 of counterbalance 122 is equipped with key slot 121*b* to receive key 119*b*. The portion of counterbalance 122 which appears in cross section encircles and is integral with collar portion 120. Counterbalance 122 further includes radial sector portion 124 which lies in a plane substantially perpendicular to, and which intersects, drive axis of rotation 28*b*''. About the periphery of radial sector portion 124 is throw portion 126. Inner piston half 114 is mounted on collar portion 120 by means of first collar bearing 128 (shown in cross section), which allows inner piston half 114 to rotate freely, clockwise or counterclockwise, about collar portion 120. Inner piston half 114 defines a first annular recess 130 to accommodate at least part of throw portion 126. After inner piston half 114 is mounted to collar portion 120, collar portion 120 may then be fitted snugly upon piston spindle 118. Next, outer piston half 116 (shown in partial break-away view for clarity) is mounted with outer collar bearing 132 onto collar portion 120. Outer piston half 116 is configured to cooperate with inner piston half 114 to form a smooth piston surface 134 and defines a second annular recess 131 which cooperates with first annular recess 130 to form piston recess 133, within which throw portion 126 is fully disposed. Like inner piston half 114, outer piston half 116 is free to rotate freely about collar portion 120. The two piston halves may be fixed together so that they rotate together, e.g., by welding, adhesion, or through a mechanical bond.

Inner piston half 114 and outer piston half 116, being radially symmetrical about centerpoint 20*b*'', would cause vibrations when rotated about drive axis of rotation 28*b*'' because their centers of mass are offset from the drive axis of rotation. Counterbalance 122, which is noncircular, occupies a portion of piston recess 133, in partial opposition to the centers of mass of piston halves 114 and 116 about drive axis of rotation 28*b*'', about which piston 16*b*' rotates. This counterbalance relationship is fixed by the disposition of key 119*b* in slot 121*b* and is effective to move the center of mass for the piston assembly closer to drive axis of rotation 28*b*'', thereby reducing vibrations.

Figure 7:
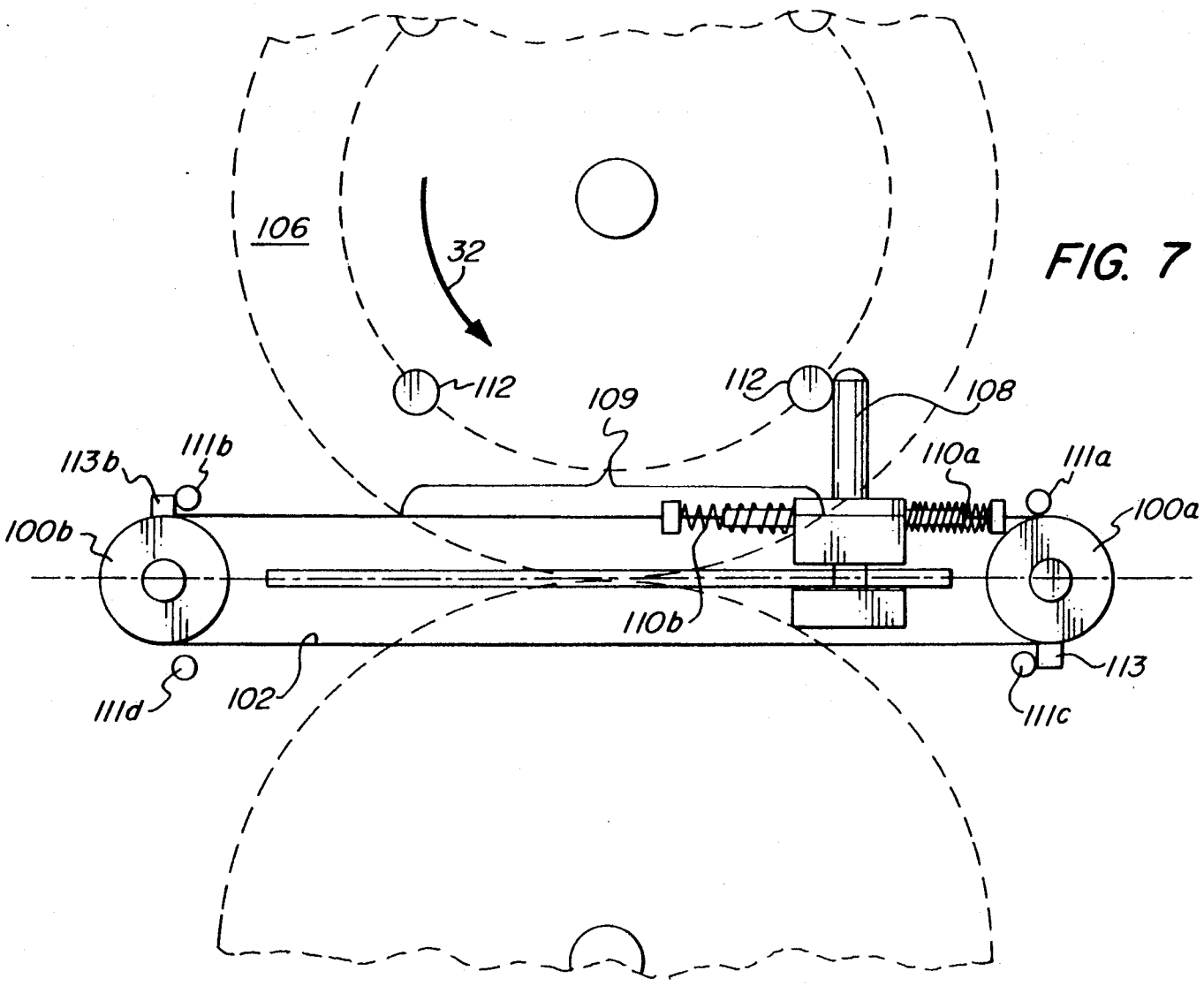
FIG. 7 is a schematic elevational view of a reversible check valve mechanism utilizable in a pump according to one embodiment of the present invention.

The direction of rotation of the rotating drive means may be reversed without defeating the advantages of this invention. When used with check valves, the check valves may be reversible. This may be accomplished by, for example, mounting the check valves in cylindrical plugs mounted in the inlet and outlet apertures. To reverse the check valves, all that need be done is to rotate the cylindrical plugs 180°, reversing the direction of the valve. This may be done manually or mechanically in response to a change in direction of the rotating drive means, the timing gears or some other related structure. For example, the cylindrical plugs bearing the check valves may be equipped with sheaves 100*a* and 100*b*, as shown in FIG. 7, which are connected by line 102. Catch member 108 is slidably mounted on a track or slide bar (not shown) so that it may slide in a path which defines a chord near the perimeter of timing gear 106 shown in dotted outline. Spring 110*a* biases catch member 108 toward the center point of chord 109 due to compression against stops 111*a* or 111*b*. Timing gear 106 is equipped with a plurality of bosses 112, only some of which are shown about the periphery of timing gear 106. As timing gear 106 rotates in the direction of arrow 32, bosses 112 sequentially bear against catch member 108, causing it to remain in the position shown in FIG. 7. However, upon reversal of the direction of rotation, catch member 108 will move toward the center of chord 109, when a boss will push catch member 108 from behind to the other end of chord 109 and compress spring 110*b* against stop 111*b*. Catch member 108 will they remain near stop 111*b* due to the repeated contacts of bosses 112 until the direction of rotation is again reversed. When catch member 108 moves in this manner, line 102 rotates sheaves 100*a* and 100*b* and the associated check valves. The radial displacement of bosses 112 and the diameter of sheaves 100*a* and 100*b* is adjusted to assure that the movement of catch member 108 from one end of chord 109 to the other corresponds to a 180° rotation of the associated check valves. To prevent accidental over-rotation, sheaves 100*a* and 100*b* are equipped with bosses 113*a* and 113*b*, respectively, which prevent rotation beyond stops 111*a* and 111*c*, and beyond 111*b* and 111*d*, respectively.

While some features are shown with respect to some embodiments and not to others, this is not intended as a limitation to the invention. These and other embodiments and improvements will be evident to one skilled in the art, and are within the spirit and scope of the invention and the following claims.

What is claimed is:

1. A dual piston rotary pump comprising:

a housing defining a pump cavity having first and second generally cylindrical chambers which intersect to form a passage therebetween;

an inlet port and an outlet port formed in the housing, each in flow communication with the pump cavity to accommodate fluid flow through the housing;

first and second cylindrical pistons mounted, respectively, within the first and second chambers on respective first and second variable offset transmission means; and first and second rotating drive means coupled, respectively, to the first and second variable offset transmission means for rotating the pistons, each drive means defining one of a pair of parallel drive axes of rotation, the variable offset transmission means serving to vary the offset of the pistons in relation to the drive axes of rotation during the course of a pumping cycle to allow the pistons to rotate in mutual contact and to reduce compression between them, the first and second variable offset transmission means being fixed to the housing, and to further allow tangential contact between at least one piston and its respective chamber wall during the pumping cycle.

2. A dual piston rotary pump comprising:

a housing defining a pump cavity having first and second generally cylindrical chambers which intersect to form a passage therebeteen;

an inlet port and an outlet port formed in the housing, each in flow communication with the pump cavity to accommodate fluid flow through the housing;

first and second cylindrical pistons mounted, respectively, within the first and second chambers on respective first and second variable offset transmission means; and first and second rotating drive means coupled, respectively, to the first and second variable offset transmission means for rotating the pistons, each drive means defining one of a pair of parallel drive axes of rotation, the variable offset transmission means serving to vary the offset of the pistons in relation to the drive axes of rotation during the course of a pumping cycle to allow the pistons to rotate in mutual contact and to reduce compression between them, the first and second variable offset transmission means being fixed to the housing, and to further allow tangential contact between at least one piston and its respective chamber wall during the pumping cycle, wherein the first and the second variable offset transmission means each comprise a slide member which carries the associated piston, the slide member being slidably engaged with the associated rotating drive means to allow the slide member to rotate the piston in response to the rotation of the rotating drive means and to vary the offset of the piston by sliding in relation to the rotating drive means.

3. The dual piston rotary pump of claim 2 wherein at least one variable offset transmission means comprises a fixed cam having a semi-elliptical portion providing a positive cam action for changing the position of the slide member in response to rotation by the rotating drive means.

4. A dual piston rotary pump comprising:

a housing defining a pump cavity having first and second generally cylindrical chambers which intersect to form a passage therebetween;

an inlet port and an outlet port formed in the housing, each in flow communication with the pump cavity to accommodate fluid flow through the housing;

first and second cylindrical pistons mounted, respectively, within the first and second chambers on respective first and second variable offset transmission means; and first and second rotating drive means coupled, respectively, to the first and second variable offset transmission means for rotating the pistons, each drive means defining one of a pair of parallel drive axes of rotation, the variable offset transmission means serving to vary the offset of the pistons in relation to the drive axes of rotation during the course of a pumping cycle to allow the pistons to rotate in mutual contact and to reduce compression between them, the first and second variable offset transmission means being fixed to the housing, and to further allow tangential contact between at least one piston and its respective chamber wall during the pumping cycle, wherein at least one variable offset transmission means comprises an extensible crank attached between the piston and the rotating drive means and further comprises at least one of a fixed cam to determine the degree of extension of the crank and a biasing means to bias the crank to bear against the cam.

5. The dual piston rotary pump of claim 3 wherein the variable offset transmission means comprises biasing means to urge the slide member against the fixed cam.

6. The dual piston rotary pump of claim 3 wherein the fixed cam is an offset split cam to provide both increasing offset and decreasing offset.

7. The dual piston rotary pump of claim 6 wherein the split cam comprises a first cam surface and a second cam surface.

8. The dual piston rotary pump of claim 7 wherein each cam surface comprises a semicircular portion and a semi-elliptical portion.

9. The dual piston rotary pump of claim 8 wherein the minor axis of a semi-elliptical portion equals the diameter of its associated semicircular portion.

10. The dual piston rotary pump of claim 3 or claim 6 wherein the slide member comprises at least one cam follower to bear against the fixed cam.

11. The dual piston rotary pump of claim 8 wherein the interior walls of the chambers have a semicircular chamber portion and a semi-elliptical chamber portion.

12. The dual piston rotary pump of claim 11 wherein the semi-elliptical chamber portions have as their minor axis the diameter of their associated semicircular chamber portion.

13. The dual piston rotary pump of claim 1 wherein the rotating drive means and the variable offset transmission means are dimensioned and configured to enable reversal of the direction of rotation of the pistons about their drive axes of rotation.

14. The dual piston rotary pump of claim 1 or claim 13 further comprising check valve means to prevent back flow through the pump.

15. The dual piston rotary pump of claim 14 wherein the check valve means is reversible.

16. The dual piston rotary pump of claim 15 further comprising automatic check valve reversal means to reverse the check valve means in response to a reverse in the direction of rotation of one of the drive means.

17. The dual piston rotary pump of claim 1 wherein the pistons comprise counterbalance means.

18. A dual piston rotary pump comprising:

a housing defining a pump cavity having a first generally cylindrical chamber having a longitudinal axis and a second generally cylindrical chamber having a longitudinal axis parallel to the longitudinal axis of the first chamber, the chambers intersecting to form a passage therebetween, the housing further defining an inlet port and an outlet port each in flow communication with the pump cavity;

a variable offset transmission means fixed to the housing proximate each chamber, and comprising an annular cam and a slide member, the annular cam having a semi-elliptical cam surface to provide a positive cam action and the slide member comprising a piston spindle disposed within each fixed cam, with the piston spindle extending into the associated chamber parallel to the longitudinal axis of the chamber, each slide member and being coupled to a rotating drive means defined below and further comprising at least one follower member for bearing against the associated cam;

a cylindrical piston rotatably mounted centrally on each piston spindle within the associated chamber; and a rotating drive means coupled to each slide member, with one of a slide member and the associated drive means having a slot and the other having a tongue slidably disposed in the slot, and each rotating drive means having a drive axis of rotation offset from the associated piston spindle, for rotating the pistons by rotating the associated slide members, whereby each fixed cam varies the offset as the rotating drive means rotate the associated pistons, causing each piston to rotate in a semicircular, semi-elliptical path about the associated drive axis of rotation.

19. The dual piston rotary pump of claim 1 or claim 2 wherein the pistons are rotatably mounted on their respective variable offset transmission means, whereby the pistons can rotate thereon, relative to their respective variable offset transmission means.

20. The dual piston rotary pump of claim 19 further comprising counterbalance means fixedly mounted to the variable offset transmission means for at least partially balancing the weight distribution about the drive axes of rotation.

* * * * *